US007645311B2

(12) United States Patent
Oh et al.

(10) Patent No.: US 7,645,311 B2
(45) Date of Patent: Jan. 12, 2010

(54) CYCLONE UNIT AND CONTAMINANTS-COLLECTING APPARATUS HAVING THE SAME

(75) Inventors: Jang-keun Oh, Gwangju (KR); Dong-hun Yoo, Gwangju (KR); Myoung-sun Choung, Gwangju (KR); Jae-sun You, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 552 days.

(21) Appl. No.: 11/473,817

(22) Filed: Jun. 23, 2006

(65) Prior Publication Data

US 2007/0012003 A1 Jan. 18, 2007

Related U.S. Application Data

(60) Provisional application No. 60/757,171, filed on Jan. 6, 2006, provisional application No. 60/698,449, filed on Jul. 12, 2005.

(30) Foreign Application Priority Data

Aug. 16, 2005 (KR) ..... 10-2005-0074952
Feb. 20, 2006 (KR) ..... 10-2006-0016034

(51) Int. Cl.
*B01D 45/12* (2006.01)

(52) U.S. Cl. ..... 55/429; 55/459.1; 55/459.4; 55/DIG. 3; 15/353

(58) Field of Classification Search ..... 55/337, 55/429, 447, 456, 457, 459.1–459.5, DIG. 53, 55/DIG. 3, 428; 15/353
See application file for complete search history.

(56) References Cited

U.S. PATENT DOCUMENTS

| | | | | |
|---|---|---|---|---|
| 883,413 | A | 3/1908 | Mahony | 15/323 |
| 5,715,566 | A | 2/1998 | Weaver et al. | 15/320 |
| 6,398,834 | B2 | 6/2002 | Oh | 55/424 |

(Continued)

FOREIGN PATENT DOCUMENTS

DE 19938774 3/2001

(Continued)

OTHER PUBLICATIONS

Search Report from corresponding European Patent Office dated Apr. 2, 2007 regarding Application 06291117.7-1256.

(Continued)

*Primary Examiner*—Duane Smith
*Assistant Examiner*—Dung Bui
(74) *Attorney, Agent, or Firm*—Ohlandt, Greeley, Ruggiro & Perle, L.L.P.

(57) ABSTRACT

The present invention relates to a cyclone unit and a contaminants-collecting apparatus having the same. The cyclone unit includes a cylindrical body disposed inside a dust-collecting receptacle; at least one supporting bracket extending from an outer circumferential surface of the cylindrical body to an inner circumferential surface of the dust collecting receptacle to support the cylindrical body and to separate the cylindrical body from the inner circumferential surface of the dust-collecting receptacle; and an air inlet pipe having one end in fluid communication with the air inlet port of the dust-collecting receptacle and the other end in fluid communication with the cylindrical body in a tangential direction.

19 Claims, 7 Drawing Sheets

U.S. PATENT DOCUMENTS

| | | | | |
|---|---|---|---|---|
| 7,422,615 | B2 * | 9/2008 | Kim | 55/426 |
| 2002/0011053 | A1 | 1/2002 | Oh | 55/426 |

FOREIGN PATENT DOCUMENTS

| | | |
|---|---|---|
| FR | 847805 | 10/1939 |
| GB | 2362341 | 11/2001 |
| GB | 2403134 | 12/2004 |
| KR | 1020030094871 | 12/2003 |
| RU | 2132218 | 6/1999 |
| RU | 2199261 | 2/2003 |
| RU | 2234232 | 8/2004 |
| WO | WO 02/34365 | 5/2002 |
| WO | WO03/030702 | 3/2003 |

OTHER PUBLICATIONS

Extended European Search Report dated Apr. 2, 2007 issued from the European Patent Office with respect to the European Patent Application No. 06291117.7.

Office Action dated Jul. 30, 2007 corresponding to Russian Patent Application No. 2006124634.

* cited by examiner

CYCLONE UNIT AND CONTAMINANTS-COLLECTING APPARATUS HAVING THE SAME

CROSS-REFERENCE TO RELATED APPLICATIONS

This application claims the benefit of U.S. provisional applications Nos. 60/698,449, filed Jul. 12, 2005, and 60/757,171 filed Jan. 6, 2006 in the United States Patent & Trademark Office, and claims the benefit of Korean Patent Applications Nos. 2005-74952, filed Aug. 16, 2005 and 2006-16034 filed Feb. 20, 2006 in the Korean Intellectual Property Office, the disclosures of all of which are incorporated herein by reference in their entirety.

BACKGROUND OF THE INVENTION

1. Field of the Invention

The present invention relates to a vacuum cleaner. More particularly, the present invention relates to a cyclone unit that separates and collects contaminants from outside air and then discharges clean air and a contaminants-collecting apparatus having the same.

2. Description of the Related Art

Generally, a vacuum cleaner employs a dust-collecting receptacle that separates contaminants from outside air entered through a suction nozzle, collects separated contaminants, and then, discharges clean air to the outside.

The conventional dust-collecting receptacle is formed in a substantially cylindrical shape. Contaminants-laden air enters into the dust collecting receptacle in a substantially tangential direction to the dust collecting receptacle, and then, rises up along an inside surface of the dust collecting receptacle. Contaminants are separated from the contaminants-laden air by centrifugal force, and then, fall to a lower portion of the dust collecting receptacle by their own weight. Air separated from contaminants is discharged outside through an air-discharging pipe formed on an upper portion of the dust-collecting receptacle.

However, the conventional dust-collecting receptacle has less dust collecting performance than a dust-collecting receptacle having a cyclone structure formed integrally therein. Therefore, when users having the conventional vacuum cleaner employing no cyclone structure want excellent cleaning effect, the users are required to buy a vacuum cleaner having a cyclone structure leaving the conventional vacuum cleaner alone. As a result, an enormous burden of cost will be imposed on the users.

SUMMARY OF THE INVENTION

The present invention has been developed in order to overcome the above drawbacks and other problems associated with the conventional arrangement. An aspect of the present invention is to provide a cyclone unit that can be easily disposed in the conventional dust-collecting receptacle and a contaminants-collecting apparatus having the same. The above aspect and/or other feature of the present invention can substantially be achieved by providing a cyclone unit for separating contaminants from contaminants-laden air drawn through an air inlet port of a dust-collecting receptacle via a suction nozzle of a vacuum cleaner and for discharging air having contaminants separated to an air-discharging pipe, which comprises a cylindrical body disposed inside the dust-collecting receptacle; at least one supporting bracket extending from an outer circumferential surface of the cylindrical body to an inner circumferential surface of the dust collecting receptacle to support the cylindrical body and to separate the cylindrical body from the inner circumferential surface of the dust-collecting receptacle; and an air inlet pipe having one end in fluid communication with the air inlet port of the dust-collecting receptacle and the other end in fluid communication with the cylindrical body in a tangential direction.

According to an embodiment of the present invention, an end of the at least one supporting bracket may be bonded on the inner circumferential surface of the dust-collecting receptacle by thermal fusion bonding.

The air inlet pipe may be extended to wrap around some outer circumferential surface of the cylindrical body to increase the whirling degree of the contaminants-laden air.

The cyclone unit may further comprise a helical guide disposed inside the cylindrical body to whirl the contaminants-laden air entered inside the cylindrical body through the air inlet pipe and to guide the contaminants-laden air to the air-discharging pipe formed at an upper side of the cylindrical body.

A width of the at least one supporting bracket may have the same dimension as a dimension of an outer diameter of the air inlet pipe.

The cylindrical body may further comprise a center shaft disposed at a center thereof for the contaminants-laden air to whirl smoothly therein.

According to another aspect of the present invention, a contaminants collecting apparatus for a vacuum cleaner comprises: a body having an air inlet through which contaminants-laden air entered via a suction nozzle of the vacuum cleaner passes, collecting and discharging contaminants; and a cyclone unit comprising: a cylindrical body disposed inside the body; at least one supporting bracket extending from an outer circumferential surface of the cylindrical body to an inner circumferential surface of the body to support the cylindrical body and to separate the cylindrical body from the inner circumferential surface of the body; an air inlet pipe having one end in fluid communication with the air inlet port of the body and the other end in fluid communication with the cylindrical body in a tangential direction; and a helical guide disposed inside the cylindrical body to whirl the contaminants-laden air entered inside the cylindrical body through the air inlet pipe and to guide the contaminants-laden air to the air-discharging pipe formed at an upper side of the cylindrical body.

According to an embodiment of the present invention, the body further comprises an upper cover opening or closing a top end of the body, wherein the upper cover is integrally formed with an air-discharging pipe to guide air discharged from the body to the outside.

The body may further comprise a lower cover disposed at a bottom end of the body by a hinge connection to open or close the bottom end of the body.

The body may be made of transparent material or semi-transparent material.

A top end of the cyclone unit may be spaced apart from a bottom end of the upper cover so that contaminants centrifugally separated in the cyclone unit are discharged to the body.

A contaminants discharging pathway may be formed between an outer circumferential surface of the cyclone unit and an inner circumferential surface of the body, and a contaminants collecting chamber may be formed between a bottom surface of the cyclone unit and a lower cover.

The air-discharging pipe may be extended downwardly from the upper cover inside the cylindrical body of the cyclone unit.

An end of the at least one supporting bracket may be bonded on the inner circumferential surface of the body by thermal fusion bonding. Alternately, the at least one supporting bracket may be fixed to the body by at least one screw. Also, the cyclone unit comprises a plurality of supporting brackets, wherein the width of each of the plurality of supporting brackets is wider than a gap between an outer circumferential surface of the cylindrical body and an inner circumferential surface of the body so that a side end of each of the plurality of supporting brackets presses the inner circumferential surface of the body to fix the cylindrical body into the body.

The air inlet pipe may be disposed to be in contact with the inner circumferential surface of the body so that the air inlet pipe separates the cylindrical body from the inner circumferential surface of the body and supports the cylindrical body.

The air inlet pipe is bonded on the inner circumferential surface of the body by thermal fusion bonding.

An outer diameter of the air inlet pipe may be larger than a gap between an outer circumferential surface of the cylindrical body and an inner circumferential surface of the body so that the air inlet pipe presses the inner circumferential surface of the body with at least one of the plurality of supporting brackets to fix the cylindrical body into the body.

Other objects, advantages and salient features of the invention will become apparent from the following detailed description, which, taken in conjunction with the annexed drawings, discloses preferred embodiments of the invention.

BRIEF DESCRIPTION OF THE DRAWING

These and/or other aspects and advantages of the invention will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, certain exemplary embodiments of the present invention will be described in detail with reference to the accompanying drawings.

The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description of exemplary embodiments of the present invention.

Figure 1:
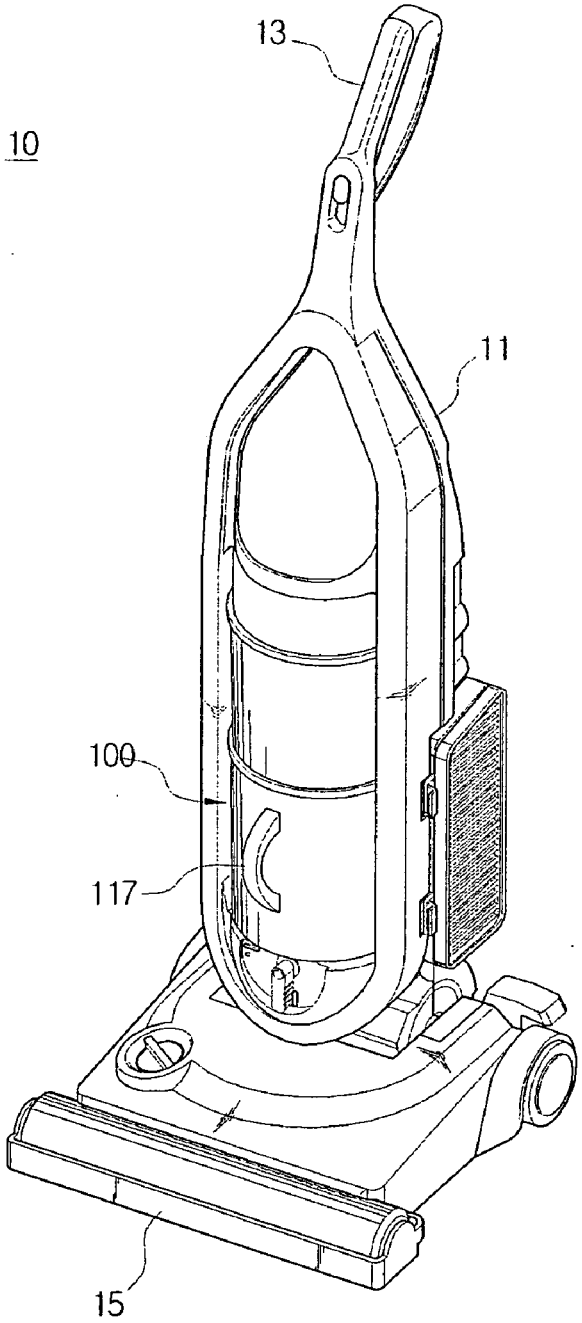
FIG. 1 is a perspective view illustrating a contaminants collecting apparatus having a cyclone unit according to an embodiment of the present invention disposed in a main body of a vacuum cleaner.

FIG. 1 is a perspective view illustrating a contaminants-collecting apparatus according to an embodiment of the present invention disposed in a vacuum cleaner. Referring to FIG. 1, the contaminants-collecting apparatus 100 according to the present invention is detachably disposed in a main body 11 of the vacuum cleaner 10. A suction nozzle 15 is pivotally connected at a bottom portion of the main body 11 of the vacuum cleaner 10, and a handle 13 is formed on a top end of the main body 11. In this embodiment of the present invention, an upright type vacuum cleaner is used as an example of vacuum cleaners employing the contaminants-collecting apparatus 100 according to an embodiment of the present invention; however, this should not be considered as limiting. Various types of vacuum cleaners such as a canister type vacuum cleaner may employ the contaminants-collecting apparatus 100 according to an embodiment of the present invention.

Figure 2:
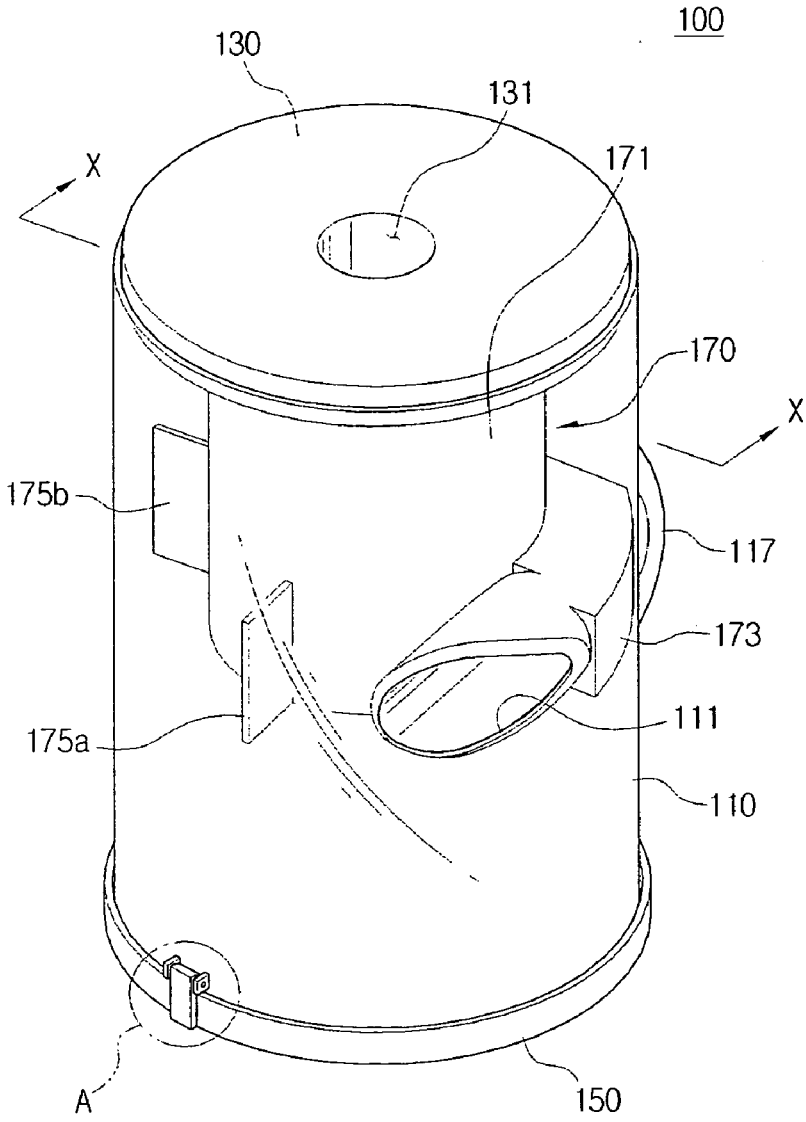
FIG. 2 is a perspective view illustrating the cyclone unit of FIG. 1.
Figure 3:
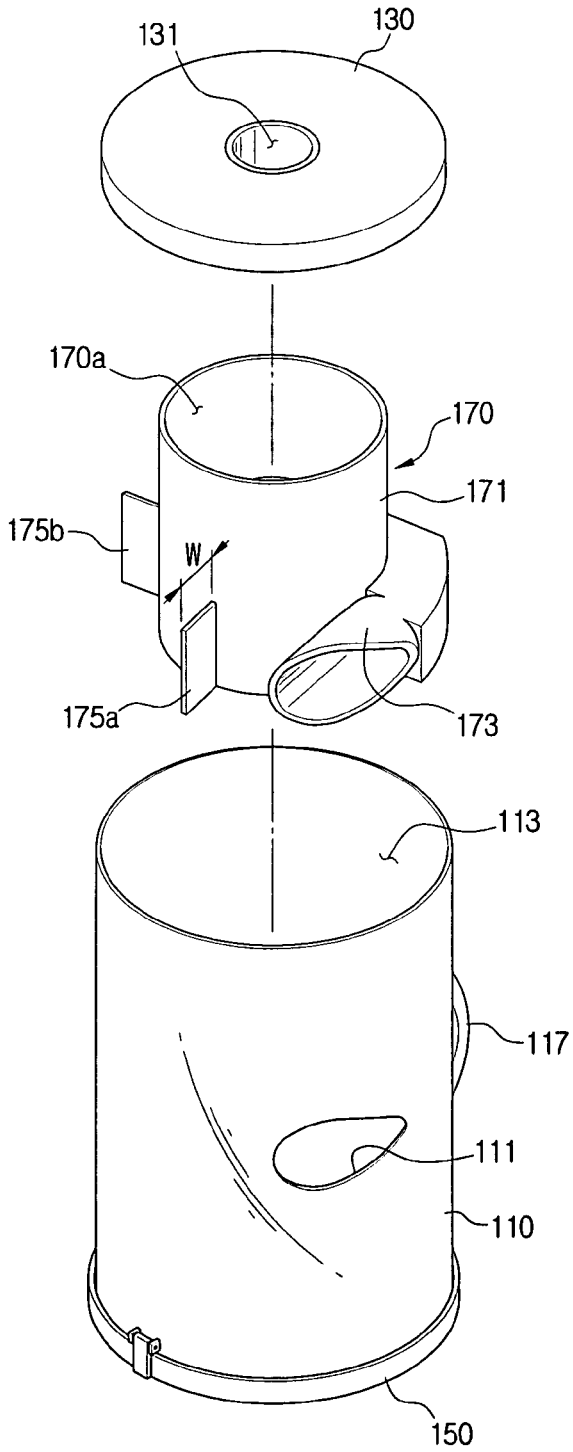
FIG. 3 is an exploded perspective view illustrating the cyclone unit of FIG. 2.

Referring to FIGS. 2 and 3, the contaminants-collecting apparatus 100 includes a body 110, an upper cover 130, a lower cover 150, and a cyclone unit 170.

The body 110 is formed in a substantially cylindrical shape with opposite opened ends. An air inlet port 111 is formed at a middle portion of the body 110 in a tangential direction to the body 110 so that contaminants-laden air enters inside the body 110 from outside. At this time, the body 110 of this embodiment has a cylindrical shape, however, this should not be considered as limiting. The body 110 may have various shapes such as a conical shape or a reversed conical shape corresponding to a part of the main body 11 of the vacuum cleaner 10 into which the contaminants collecting apparatus 100 is inserted. Also, the body 110 may be made of transparent material or semitransparent material. As a result, users can easily know the amount of contaminants collected in the body 110 without opening the upper cover 130. The body 110 corresponds to the conventional dust-collecting receptacle as described above.

The upper cover 130 is detachably disposed on a top end of the body 110 to open or close the opened top end of the body 110. The upper cover 130 has an air-discharging pipe 131 to discharge clean air to the outside of the body 110. The air-discharging pipe 131 penetrates a center of the upper cover 130 and extends downwardly from a bottom surface of the upper cover 130 inside the body 110. Therefore, the air-discharging pipe 131 is inside the cyclone unit 170. A backflow preventing dam 133 (see FIG. 6) is disposed in a ring shape on the bottom surface of the upper cover 130 to face a top end of a cylindrical body 171 (see FIG. 6). The backflow preventing dam 133 has a larger diameter than the cylindrical body 171. The backflow preventing dam 133 prevents contaminants discharging through a below-described contaminants discharging opening 114 (see FIG. 6) by centrifugal force from flowing back to the cylindrical body 171 through the contaminants discharging opening 114.

Figure 5:
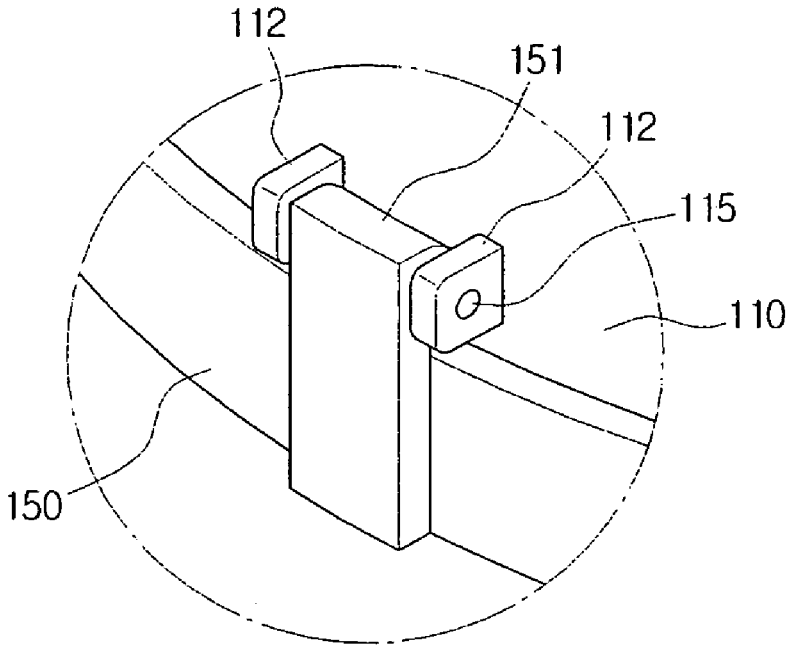
FIG. 5 is a partial enlarged perspective view illustrating A area of FIG. 2.
Figure 7:
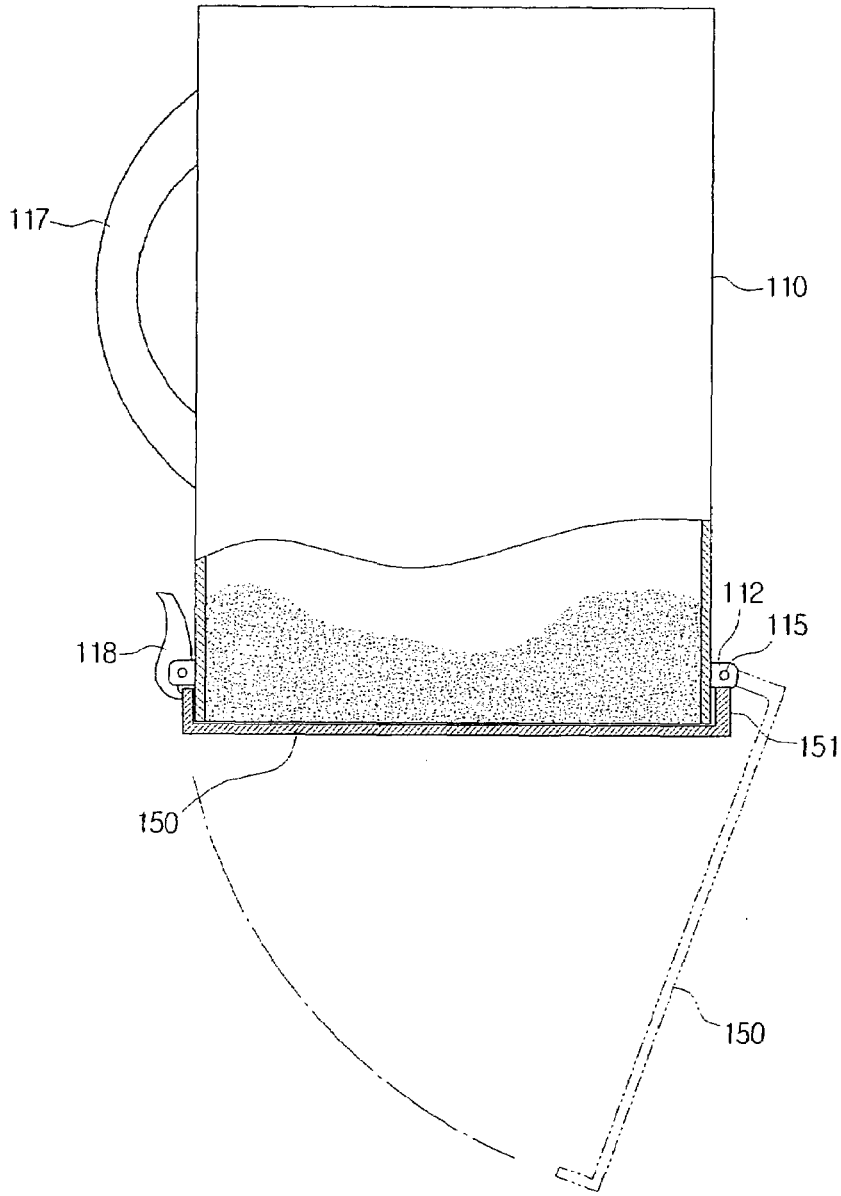
FIG. 7 is a partial sectional side view illustrating the cyclone unit of FIG. 4A viewing in a direction of arrow B in FIG. 4A.

The lower cover 150 is disposed at a bottom end of the body 110 by a hinge connection to open or close the opened bottom end of the body 110. The hinge connection of the lower cover 150 has a general hinge connection structure. For an example, the hinge connection has a pair of fixing brackets 112 (see FIG. 5) formed adjacent to the bottom end of the body 110, a hinge part 151 (see FIG. 5) formed one side of the lower cover 150 and inserted between the pair of fixing brackets 112, and a hinge shaft 115 (see FIG. 5) connecting through the fixing brackets 112 and the hinge part 151. Also, the other side of the lower cover 150 is bound by a locking lever 118 (see FIG. 7)

disposed adjacent to the bottom end of the body 110. When emptying contaminants collected in the body 110, the locking lever 118 is operated so that the lower cover 150 is released from the locking lever 118. As a result, the lower cover 150 is pivoted downwardly based on the hinge shaft 115, and then, contaminants collected on the lower cover 150 are discharged outside through the bottom end of the body 110 by the gravity.

Figure 4A:
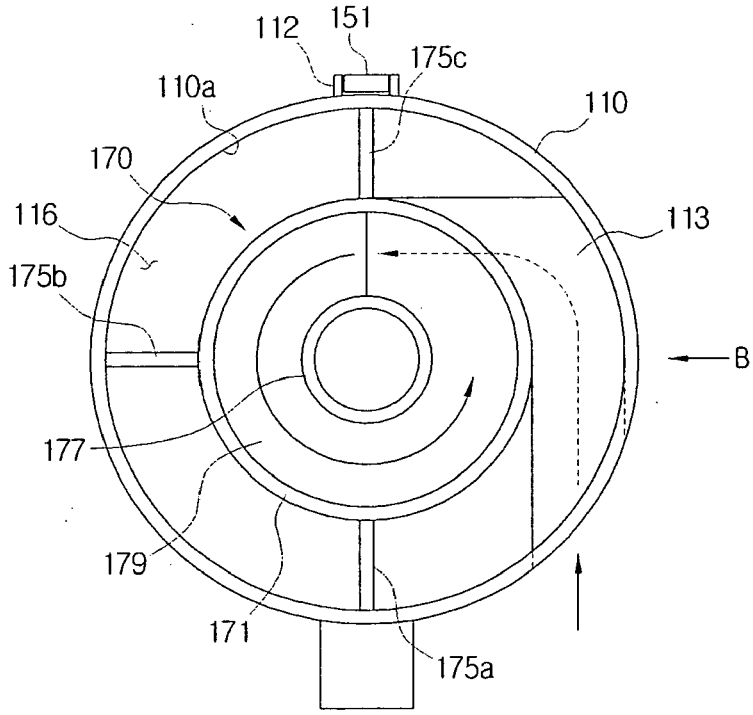
FIG. 4A is a plain view illustrating the cyclone unit of FIG. 2 without an upper cover.

Referring to FIG. 3, the cyclone unit 170 includes a cylindrical body 171, an air inlet pipe 173, a plurality of supporting brackets 175*a*, 175*b*, and 175*c*, a center shaft 177 (see FIG. 4A), and a helical guide 179 (see FIG. 4A).

The cylindrical body 171 has a less diameter than the body 10 to be inserted inside the body 110. The cylindrical body 171 is disposed inside the body 110 so that a space of the body 110 in which contaminants are collected is isolated from the air-discharging pipe 131 (see FIG. 6). As a result, the cylindrical body 171 prevents contaminants collected in the body 110 from re-scattering and discharging outside through the air-discharging pipe 131.

Figure 6:
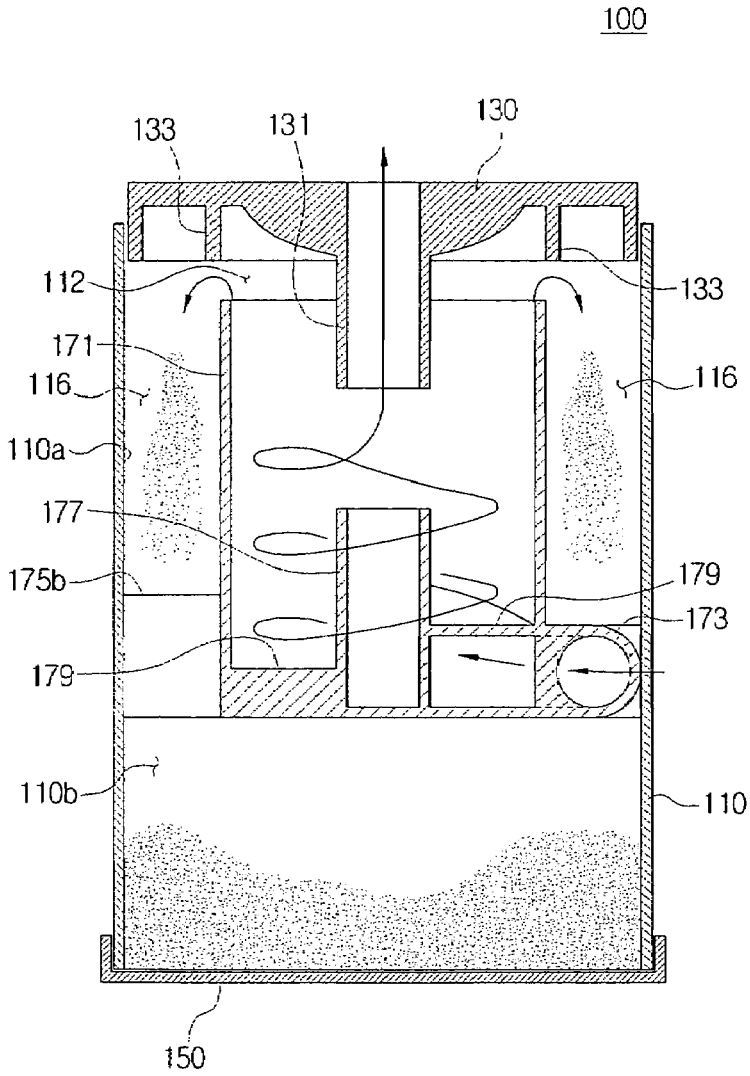
FIG. 6 is a sectional view of FIG. 2 taken along a line X-X in FIG. 2.

Furthermore, the cylindrical body 171 is disposed inside the body 110 so that a contaminants discharging opening 114, a contaminants discharging pathway 116, and a contaminants collecting chamber 117 are formed in the space 113 (see FIG. 3) of the body 110. Referring to FIG. 6, the contaminants discharging opening 114 is formed between the top end of the cylindrical body 171 and the bottom end of the upper cover 130 so that contaminants whirled upwardly along an inner circumferential surface of the cylindrical body 171 are discharged inside the body 110 through the contaminants discharging opening 114 by centrifugal force. The contaminants discharging pathway 116 is a space between an outer circumferential surface of the cylindrical body 171 and the inner circumferential surface of the body 110 to guide the contaminants passed through the contaminants discharging opening 114 downwardly. The contaminants collecting chamber 117 is a space between a bottom end of the cylindrical body 171 and the lower cover 150 to collect contaminants falling through the contaminants discharging pathway 116 by gravity.

Furthermore, the air inlet pipe 173 is in fluid communication with the air inlet port 111 of the body 110 so as to guide contaminants-laden air entering through the air inlet port 111 from the outside into the cylindrical body 171. The air inlet pipe 173 is formed in the tangential direction to the lower side of the cylindrical body 171 so that the contaminants-laden air is whirled inside the cylindrical body 171. At this time, the air inlet pipe 173 is preferably formed to wrap around some part of the outer circumferential surface of the cylindrical body 171 to increase the whirling degree of the contaminants-laden air.

The helical guide 179 (see FIG. 6) is formed between the inner circumferential surface of the cylindrical body 171 and the center shaft 177 formed in a vertical direction on a center of the cylindrical body 171. The helical guide 179 increases the whirling degree of the contaminants-laden air entered inside the cylindrical body 171 through the air inlet pipe 173. In other words, the entering contaminants-laden air is whirled more strongly due to a helical air path formed by the center shaft 177, the helical guide 179, and the cylindrical body 171.

Figure 4B:
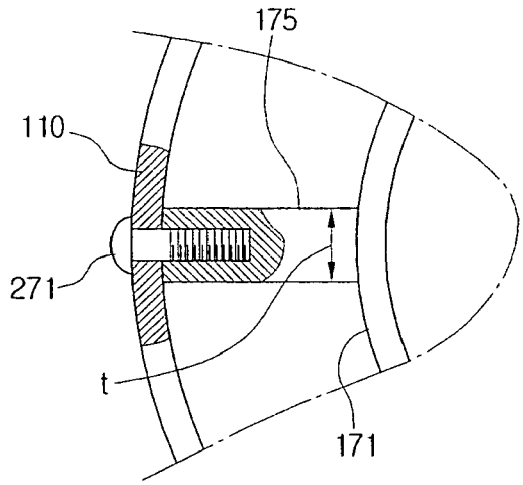
FIG. 4B is a partial enlarging view illustrating a cyclone unit fixed inside a cylindrical body by at least one screw.

The plurality of supporting brackets 175*a*, 175*b*, and 175*c* are formed at predetermined intervals on the outer circumferential surface of the cylindrical body 171. Each of the plurality of supporting brackets 175*a*, 175*b*, and 175*c* has a predetermined width to separate the cylindrical body 171 from the inner circumferential surface of the body 110. At least one of the plurality of supporting brackets 175*a*, 175*b*, and 175*c* is bonded on the inner circumferential surface 110*a* of the body 110 by thermal fusion bonding to securely fix the cylindrical body 171 into the body 110. For fixing the cylindrical body 171 to the body 110, various other suitable methods may be used in addition to the thermal fusion bonding. In one embodiment, each of the plurality of supporting brackets 175 can have a thickness (t) sufficient so that the supporting brackets 175 can be fixed on the body 110 by at least one screw 271 as shown in FIG. 4B. Another example is that the width (W) of each of the plurality of supporting brackets 175*a*, 175*b*, and 175*c* is wider than a gap between the outer circumferential surface of the cylindrical body 171 and the inner circumferential surface of the body 110 so that a side end of each of the plurality of supporting brackets 175*a*, 175*b*, and 175*c* presses the inner circumferential surface of the body 110 to fix the cylindrical body 171 into the body 110. On the other hand, each of the plurality of supporting brackets 175*a*, 175*b*, and 175*c* is formed to have the same width as a dimension of an outer diameter of the air inlet pipe 173 so that the cylindrical body 171 could be disposed in a center of the body 110.

With an embodiment of the present invention, the cyclone unit 170 is disposed in the conventional dust-collecting receptacle employing no cyclone structure and having the upper and lower cover, thereby maximizing contaminants collecting efficiency of the conventional dust collecting receptacle. Also, the cyclone unit 170 according to an embodiment of the present invention can be easily disposed into the conventional dust-collecting receptacle without substantially structural change so that the conventional dust-collecting receptacle is recyclable.

Hereinafter, operation of the contaminants collecting apparatus 100 having the cyclone unit 170 according to an embodiment of the present invention with the above-described structure will be described.

Contaminants-laden air entered into the air inlet pipe 173 via the suction nozzle 15 (see FIG. 1) from the outside enters inside the cylindrical body 171, and then, rises up to the upper cover 130 whirling along the inner circumferential surface of the cylindrical body 171. Contaminants separated from the whirling upwardly contaminants-laden air by centrifugal force are collected in the contaminants collecting chamber 117 passing through the contaminants discharging opening 114 and the contaminants discharging pathway 116 in order. Here, the backflow preventing dam 133 prevents the contaminants collected in the contaminants collecting chamber 117 from flowing back through the contaminants discharging opening 114. On the other hand, air having contaminants removed is discharged outside the contaminants collecting apparatus 100 through the air-discharging pipe 131 formed to penetrate the upper cover 130.

As described above, because the contaminants collecting apparatus 100 according to an embodiment of the present invention can use the conventional dust-collecting receptacle having no cyclonic structure without structural change as the body 110 to dispose the cyclone unit 170, it causes the conventional dust-collecting receptacle to be recycled. As a result, a burden of cost imposed on users is decreased.

According to the present invention, because the cyclone unit 170 is disposed inside the body 110 of the contaminants collecting apparatus 100, that is, inside the conventional dust-collecting receptacle, the air-discharging pipe 131 is isolated from the contaminants collecting chamber 117. As a result, contaminants collected in the contaminants collecting chamber 117 is not re-scattered. Also, when the contaminants collecting apparatus 100 is inclined, contaminants collected in the contaminants collecting chamber 117 is prevented from entering the air-discharging pipe 131.

Furthermore, because air passed through the air inlet pipe 173 is discharged through the air-discharging pipe 131 without change of a flowing direction, interference between air entering the cyclone unit 170 and air discharging outside is minimized. As a result, loss of suction force is decreased. Also, the air inlet pipe 173 is extended to wrap around the outer circumferential surface of the cylindrical body 171 so that air entered from outside rotates along some part of the outer circumferential surface of the cylindrical body 171, and then, to enter inside the cylindrical body 171. Therefore, whirling degree of air entering the cylindrical body 171 is increased.

While the embodiments of the present invention have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A cyclone unit for separating contaminants from contaminants-laden air drawn through an air inlet port of a dust-collecting receptacle via a suction nozzle of a vacuum cleaner and for discharging air having contaminants separated to an air-discharging pipe, the cyclone unit comprising:

a cylindrical body disposed inside the dust-collecting receptacle;

at least one supporting bracket extending from an outer circumferential surface of the cylindrical body to an inner circumferential surface of the dust-collecting receptacle to support the cylindrical body and to separate the cylindrical body from the inner circumferential surface of the dust-collecting receptacle; and an air inlet pipe having one end in fluid communication with the air inlet port of the dust-collecting receptacle and the other end in fluid communication with the cylindrical body in a tangential direction.

2. The cyclone unit of claim 1, wherein the at least one supporting bracket has an end bonded on the inner circumferential surface of the dust-collecting receptacle by thermal fusion bonding.

3. The cyclone unit of claim 1, wherein the air inlet pipe wraps around some outer circumferential surface of the cylindrical body to increase the whirling degree of the contaminants-laden air.

4. The cyclone unit of claim 1, further comprising:

a helical guide disposed inside the cylindrical body to whirl the contaminants-laden air entering the cylindrical body through the air inlet pipe and to guide the contaminants-laden air to the air-discharging pipe formed at an upper side of the cylindrical body.

5. The cyclone unit of claim 1, wherein the at least one supporting bracket has a width that is the same dimension as a dimension of an outer diameter of the air inlet pipe.

6. The cyclone unit of claim 1, wherein the cylindrical body further comprises a center shaft disposed at a center thereof for the contaminants-laden air to whirl smoothly therein.

7. A contaminants collecting apparatus for a vacuum cleaner comprising:

a body having an air inlet through which contaminants-laden air entering via a suction nozzle of the vacuum cleaner can pass, in which contaminants separated from the contaminants-laden air can be collected, and from which clean air can be discharged; and a cyclone unit comprising:

a cylindrical body disposed inside the body;

at least one supporting bracket extending from an outer circumferential surface of the cylindrical body to an inner circumferential surface of the body to support the cylindrical body and to separate the cylindrical body from the inner circumferential surface of the body;

an air inlet pipe having one end in fluid communication with the air inlet of the body and the other end in fluid communication with the cylindrical body in a tangential direction; and a helical guide disposed inside the cylindrical body to whirl the contaminants-laden air entering the cylindrical body through the air inlet pipe and to guide the contaminants-laden air to the air-discharging pipe formed at an upper side of the cylindrical body.

8. The contaminants collecting apparatus of claim 7, wherein the body further comprises an upper cover opening or closing a top end of the body, wherein the upper cover is integrally formed with the air-discharging pipe to guide the clean air discharged from the body to the outside.

9. The contaminants collecting apparatus of claim 7, wherein the body further comprises a lower cover disposed at a bottom end of the body by a hinge connection to open or close the bottom end of the body.

10. The contaminants collecting apparatus of claim 7, wherein the body is made of transparent material or semi-transparent material.

11. The contaminants collecting apparatus of claim 8, wherein the cyclone unit has a top end that is spaced apart from a bottom end of the upper cover so that contaminants centrifugally separated in the cyclone unit are discharged to the body.

12. The contaminants collecting apparatus of claim 7, further comprising a contaminants discharging pathway formed between an outer circumferential surface of the cyclone unit and an inner circumferential surface of the body and a contaminants collecting chamber formed between a bottom surface of the cyclone unit and a lower cover.

13. The contaminants collecting apparatus of claim 7, wherein the air-discharging pipe extends downwardly from the upper cover inside the cylindrical body of the cyclone unit.

14. The contaminants collecting apparatus of claim 7, wherein the at least one supporting bracket has an end that is bonded on the inner circumferential surface of the body by thermal fusion bonding.

15. The contaminants collecting apparatus of claim 7, wherein the at least one supporting bracket is fixed to the body by at least one screw.

16. The contaminants collecting apparatus of claim 7, wherein the cyclone unit comprises a plurality of supporting brackets, wherein the width of each of the plurality of supporting brackets is wider than a gap between an outer circumferential surface of the cylindrical body and an inner circumferential surface of the body so that a side end of each of the plurality of supporting brackets presses the inner circumferential surface of the body to fix the cylindrical body into the body.

17. The contaminants collecting apparatus of claim 7, wherein the air inlet pipe is in contact with the inner circumferential surface of the body so that the air inlet pipe separates the cylindrical body from the inner circumferential surface of the body and supports the cylindrical body.

18. The contaminants collecting apparatus of claim 17, wherein the air inlet pipe is bonded on the inner circumferential surface of the body by thermal fusion bonding.

19. The contaminants collecting apparatus of claim 17, the air inlet pipe has an outer diameter that is larger than a gap between an outer circumferential surface of the cylindrical body and an inner circumferential surface of the body so that the air inlet pipe presses the inner circumferential surface of the body with at least one of the plurality of supporting brackets to fix the cylindrical body into the body.

* * * * *